United States Patent [19]

Fujiya

[11] Patent Number: 4,519,641

[45] Date of Patent: May 28, 1985

[54] DOOR OPENING-CLOSING APPARATUS FOR LARGE-SIZED REFRIGERATOR OR THE LIKE

[76] Inventor: Toshimichi Fujiya, No. 4-22, Kounandai 6-chome, Kounan-ku, Yokohama-shi, Kanagawa-ken, Japan

[21] Appl. No.: 471,258

[22] Filed: Mar. 2, 1983

[51] Int. Cl.[3] ..... E05C 19/12

[52] U.S. Cl. ..... 292/127; 70/92; 292/126; 292/DIG. 71

[58] Field of Search ..... 292/221, 227, 127, 126, 292/119, DIG. 62, DIG. 71; 70/92

[56] References Cited

U.S. PATENT DOCUMENTS

| | | | |
|---|---|---|---|
| 435,109 | 8/1890 | Woodcock | 292/221 |
| 517,353 | 3/1894 | Millard | 292/101 |
| 2,144,737 | 1/1939 | McCabe | 292/127 X |
| 2,655,395 | 10/1953 | Groeger | 292/126 X |
| 2,773,376 | 12/1956 | Wartian | 292/221 X |
| 3,364,706 | 1/1968 | Adam | 292/227 X |
| 4,203,622 | 5/1980 | Cook et al. | 292/DIG. 71 X |
| 4,280,725 | 7/1981 | Berkowitz et al. | 292/DIG. 71 X |

FOREIGN PATENT DOCUMENTS

| | | | |
|---|---|---|---|
| 41-1595 | 2/1966 | Japan . | |
| 986774 | 3/1965 | United Kingdom | 292/DIG. 71 |
| 2084643 | 4/1982 | United Kingdom | 70/92 |

*Primary Examiner*—Gary L. Smith
*Assistant Examiner*—Russell W. Illich
*Attorney, Agent, or Firm*—Martin Smolowitz

[57] ABSTRACT

A door opening-closing apparatus for large-sized refrigerators, the apparatus having a grip seat secured to a door, and a grip, acutating lever, and latch pivotally attached to the grip seat, a push rod penetrating the door, and a latch support. The outer end of the push rod is brought into contact with one end of the actuating lever, and one end of the latch is contacted with the other end of the actuating lever. The actuating lever is pivoted by pushing against the inner end of the push rod to undo the engagement between the latch support and the other end of the latch. The push rod is disposed inclined with respect to the door, so as to be more remote from the side pillar as the push rod extends from the outer end to the inner end thereof. By this arrangement, the push rod can be advantageously disposed closer to the side pillar without any fear of collision between the push rod inner and the side pillar.

6 Claims, 3 Drawing Figures

DOOR OPENING-CLOSING APPARATUS FOR LARGE-SIZED REFRIGERATOR OR THE LIKE

BACKGROUND OF INVENTION

The present invention relates to door opening-closing apparatus for large-sized refrigerators and freezers, which apparatus is capable of unlocking and opening the door from within the compartment thereof.

As shown in Japanese Utility Model Publication No. 1595/1966, a known door opening-closing apparatus capable of unlocking and opening the door from within the compartment comprises: a grip and an actuating lever pivotably attached to a grip seat secured to a door; a push rod penetrating the door from inside to outside and having the outer end thereof brought into contact with one end of the actuating lever; and a latch pivotably attached to the grip seat and having one end thereof brought into contact with the other end of the actuating lever, whereby pivoting the actuating lever by pushing the inner end of the push rod makes it possible to undo the engagement between a latch support secured to a side pillar of the compartment and the other end of the latch.

In the apparatus of this kind, since the grip seat has a large volume as compared with the grip and latch support, if the grip seat is reduced in size, the production cost of the whole of the apparatus is cut down correspondingly. However, a reduction in size of the grip seat means a decrease in length of the actuating lever arm. Consequently, in order to rotate the actuating lever by a required angle, it is necessary to allow the push rod to greatly project inside the compartment so that the stroke of the push rod becomes longer. Although the projecting length of the push rod inside the compartment must be determined so that the inner end of the push rod will not collide or rub against the side pillar when the door is opened or closed, the projecting length is primarily limited to a short length in the case where the push rod is provided closer to the side pillar owing to the reduction in size of the grip seat. In addition, when the push rod is disposed perpendicularly to the door such as in the conventional apparatus disclosed in the above-mentioned publication, the projecting length of the push rod is further limited. Therefore, there is naturally a limitation in reduction of the grip seat in size.

SUMMARY OF INVENTION

It is, therefore, an object of the present invention to provide a door opening-closing apparatus in which even if the push rod is disposed closer to the side pillar of the compartment, the projecting length of the push rod inside the compartment can be made satisfactorily long without any fear of collision between the push rod inner end and the side pillar, or the like, thereby allowing the grip seat to be largely reduced in size.

The door opening-closing apparatus according to the invention provides a grip seat to be secured to a door, and a grip, an actuaing lever, and a latch each mutually pivotally attached to the grip seat, a push rod penetrating the door, and a latch support to be secured to a side pillar of a compartment. The outer end of the push rod is brought into contact with one end of the actuating lever, and the other end of the latch is contacted with the other end of the actuating lever. The actuating lever is pivoted by pushing against the inner end of the push rod to undo the engagement between the latch support and the other end of the latch. The invention features the push rod provided being inclined with respect to the door, so that the push rod is more remote from the side pillar of the compartment as the push rod extends from the outer end of the push rod to the inner end thereof. The push rod can advantageously be disposed closer to the side pillar without any fear of collision between the push rod inner end and the side pillar.

The invention will be described hereinunder in greater detail through a preferred embodiment with reference to the accompanying drawings.

DETAILED DESCRIPTION OF PREFERRED EMBODIMENT

Figure 1:
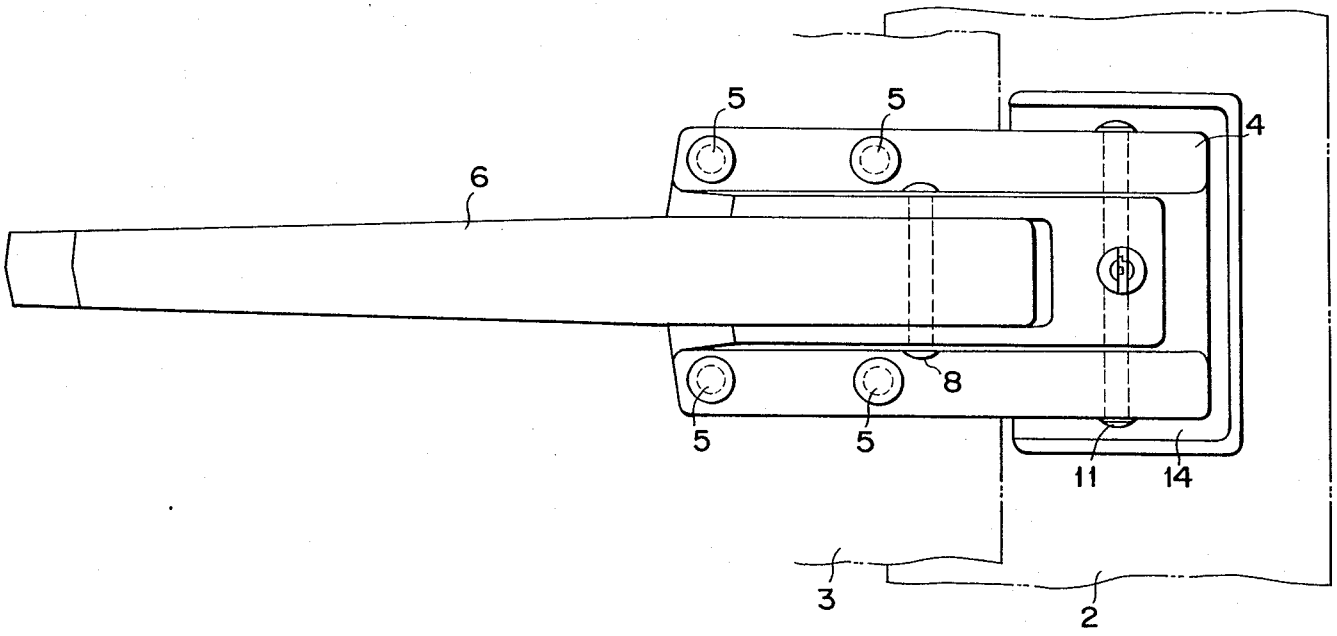
FIG. 1 is a front elevational view of a door opening-closing apparatus according to the invention.
Figure 2:
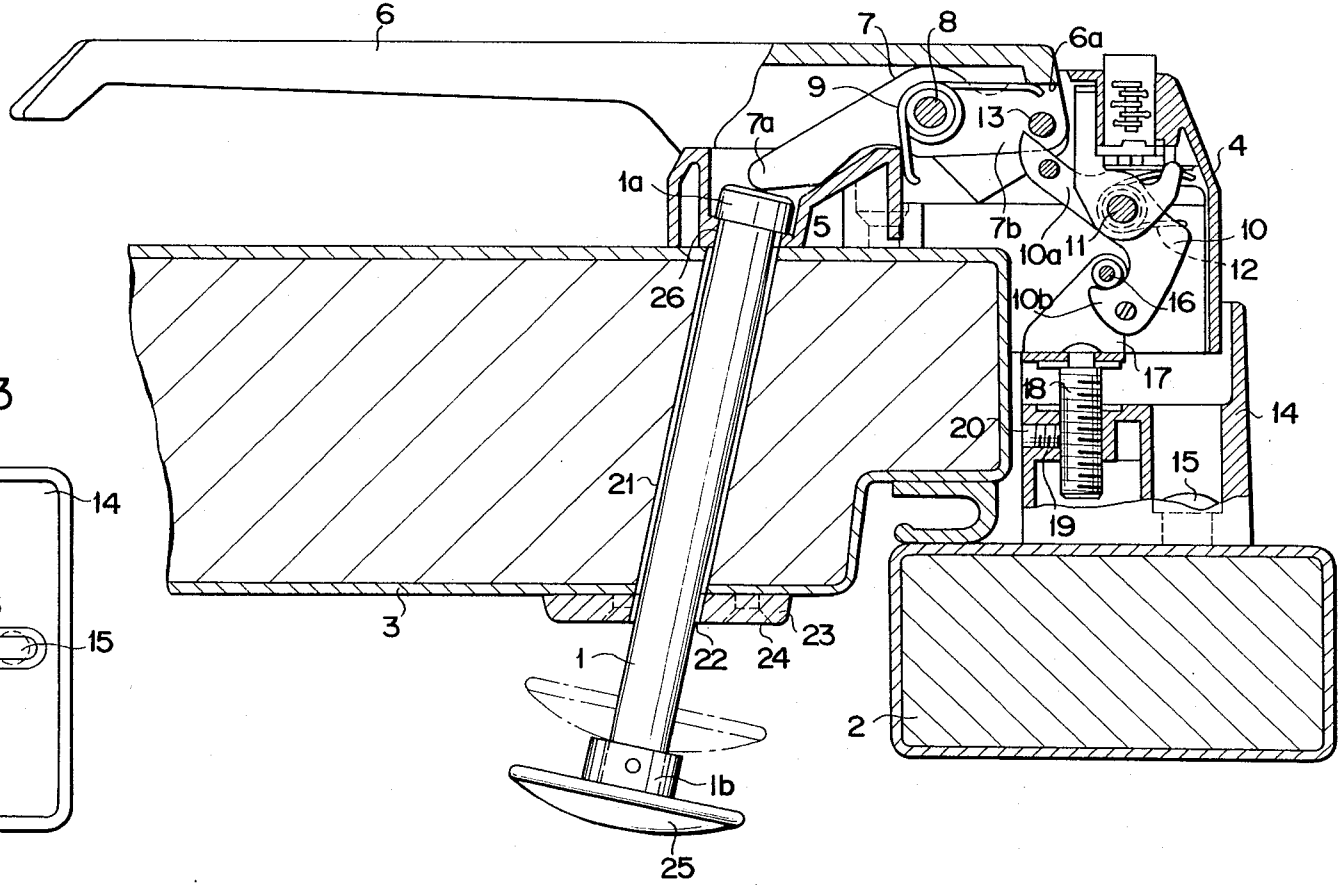
FIG. 2 is a sectional view taken along a line A—A′ of FIG. 1.

As shown in FIGS. 1 and 2, a grip seat 4 is secured to a door 3 by four screws 5. A grip or handle 6 and an actuating lever 7 are pivotably attached to the grip seat 4 by a mutual pivot 8. The grip 6 is held in its lying position by a spring 9 fitted on the pivot 8. One end 7*a* of the actuating lever 7 is obliquely projected toward the door 3. A latch 10 in the bell-crank shape is pivotably attached to the grip seat 4 by another pivot 11 and biased by a spring 12 fitted on the pivot 11 so as to rotate the latch clockwise as viewed in FIG. 2. One end 10*a* of the latch 10 presses against a pin 13 at the other end 7*b* of the actuating lever 7. Consequently, the end 7*b* of the actuating lever 7 is brought into resilient contact with an end inner surface 6*a* of the grip 6.

Figure 3:
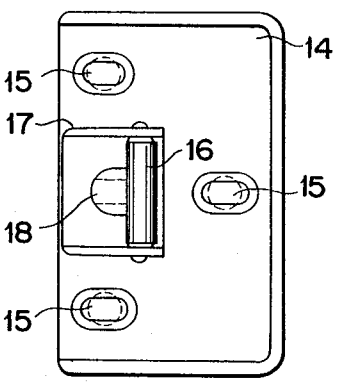
FIG. 3 is a front elevational view of a latch support employed in the door opening-closing apparatus shown in FIG. 1.

As further shown by FIG. 3, a latch support seat 14 is secured to a side pillar 2 of a compartment by three screws 15. A pin-shaped latch support 16 adapted to engage with the other end 10*b* of the latch 10 is supported by a support member 17 having its bolt portion 18 screwed into a screw hole 19 formed in the latch support seat 14. Therefore, the projecting position of the latch support 16 can be properly regulated with respect to the side pillar 2. Then, tightening an orthogonal screw 20 permits the latch support 16 to be fixed in the regulated position.

An inclined through-hole 21 is formed in the door 3. A guide plate 23 having a slot 22 is secured to the inside surface of the door 3 by means of a screw 24. A knob 25 is fixed to the inner end 1*b* of a push rod 1. The outer end 1*a* of the push rod 1 has a slightly larger diameter so as to abut against the edge surface of a guide hole 26 in grip seat 4, thereby preventing the push rod 1 from slipping out.

In the apparatus in accordance with this embodiment of the invention, in order to unlock and open the door from outside the compartment, it is necessary only to pull and rotate the grip 6 clockwise about the pivot 8, as shown in FIG. 2. Thus, the end inner surface 6*a* of the grip 6 pushes the end 7*b* of the actuating lever 7. Consequently, the actuating lever 7 is rotated clockwise, causing the latch 10 to rotate counter-clockwise about the pivot 11. Since this rotation allows the end 10*b* of the latch 10 to disengage from the latch support 16, the locking of the door 3 with respect to the side pillar 2 is undone, thereby making the door 3 openable. On the other hand, in order to open the door from within the compartment, it is necessary only to push the push against rod 1 by holding the knob 25. Thus, the end 7*a* of the actuating lever 7 is pushed by the outer end 1*a* of the push rod 1, causing the actuating lever 7 to rotate clockwise about the pivot 8. Consequently, the latch 10 interlocked therewith is rotated counter-clockwise to disengage from the latch support 16. The unlocked door 3 is opened by further pushing the knob 25. When the pressing against the knob 25 is stopped, the push rod 1 is immediately returned to its orginal position shown by solid lines by the function of the spring 12 indirectly acting through the latch 10 and the actuating lever 7.

As will be fully understood from the foregoing description, in the door opening-closing apparatus according to the invention, since the push rod 1 is provided inclined with respect to the door 3 so as to be more remote from the side pillar 2 of the compartment as it goes from the outer end 1*a* to the inner end 1*b*, even if the push rod 1 is disposed considerably close to the side pillar 2, the projecting length of the push rod can be made satisfactorily long without any fear of collision between the push rod inner end and the side pillar, or the like. Since the stroke of the push rod 1 can be made longer, and since the length of the arm of the actuating lever 7 can be decreased correspondingly, it becomes possible to correspondingly reduce in size the grip seat 4 for housing the same. Accordingly, it is possible to cut down the production cost of the entire door opening-closing apparatus.

What I claim is:

1. A door opening-closing apparatus for large-sized compartments said apparatus comprising:

a grip seat adapted to be secured to a door; a grip and an actuating lever which are mutually pivotable about a pivot pin attached to said grip seat;

a latch support seat adapted to be secured to a side pillar of the compartment;

a push rod adapted for penetrating a door from inside to outside, the outer end of said push rod being brought into contact with one end of said actuating lever; and a latch pivotably attached to said grip seat, one end of said latch being contacted by the other end of said actuating lever, whereby pivoting said actuating lever by pushing against the inner end of said push rod will undo the engagement between said latch support secured to the side pillar of the compartment and the other end of said latch, said push rod being inclined with respect to the door so as to be more remote from the side pillar as the rod extends from said outer end to said inner end thereof.

2. A door opening-closing apparatus according to claim 1, wherein said latch is biased by spring means so as to maintain the latch in contact with the latch support seat.

3. A door opening-closing apparatus according to claim 1, wherein said latch support seat contains a pin-shaped latch support.

4. A door opening-closing apparatus according to claim 3, wherein said latch support is attached to said latch support seat by a threaded connection and the location of said latch support is adjustable relative to the side pillar.

5. A door opening-closing apparatus for large-sized compartments said apparatus comprising:

a grip seat adapted to be secured to a door;

a grip and an actuating lever which are mutually pivotable about a pivot pin attached to said grip seat;

a latch support seat adapted to be secured to a side pillar of the compartment, and containing a pin-shaped latch support;

a push rod for penetrating the door from inside to outside, the outer end of said push rod being brought into contact with one end of said actuating lever; and a latch pivotably attached to said grip seat, one end of said latch being contacted by the other end of said actuating lever, said latch being biased by spring means so as to maintain the latch in contact with said latch support, whereby pivoting said actuating lever by pushing against the inner end of said push rod will undo the engagement between said latch support secured to the side pillar of the compartment and the other end of said latch, said push rod being disposed inclined with respect to the door so as to be more remote from the side pillar as the rod extends from said outer end to said inner end thereof.

6. A door opening-closing apparatus for large-sized compartments, said apparatus comprising:

a grip seat secured to a door;

a grip and an actuating lever which are mutually pivotable about a pivot pin attached to said grip seat;

a latch support seat secured to a side pillar of the compartment;

a push rod penetrating the door from inside to outside, the outer end of said push rod being brought into contact with one end of said actuating lever; and a latch pivotably attached to said grip seat, one end of said latch being contacted by the other end of said actuating lever, whereby pivoting said actuating lever by pushing against the inner end of said push rod will undo the engagement between said latch support secured to the side pillar of the compartment and the other end of said latch, said push rod being disposed inclined with respect to the door so as to be more remote from the side pillar as the rod extends from said outer end to said inner end thereof.

* * * * *